US007469899B1

(12) United States Patent
Rogers et al.

(10) Patent No.: US 7,469,899 B1
(45) Date of Patent: Dec. 30, 2008

(54) ELECTRONIC BOARD GAME SYSTEM WITH AUTOMATED OPPONENT

(76) Inventors: Anthony R. Rogers, 29 Friends La., Newtown, PA (US) 18940; Paul Boxmeyer, 29 Friends La., Newtown, PA (US) 18940; Robert Butkiewicz, 4201 Church Rd. Suite 254, Mount Laurel, NJ (US) 08054; James Carty, 4201 Church Rd. Suite 254, Mount Laurel, NJ (US) 08054

( * ) Notice: Subject to any disclaimer, the term of this patent is extended or adjusted under 35 U.S.C. 154(b) by 503 days.

(21) Appl. No.: 11/188,268

(22) Filed: Jul. 25, 2005

(51) Int. Cl.
*A63F 3/00* (2006.01)

(52) U.S. Cl. ..... 273/237; 273/444

(58) Field of Classification Search ..... 273/237, 273/444, 448, 459–460
See application file for complete search history.

(56) References Cited

U.S. PATENT DOCUMENTS 4,398,720 A * 8/1983 Jones et al. ..... 463/14
4,799,678 A * 1/1989 Terzian et al. ..... 463/32

* cited by examiner

*Primary Examiner*—Robert E Pezzuto
*Assistant Examiner*—Alex F. R. P. Rada, II
(74) *Attorney, Agent, or Firm*—LaMonte & Associates

(57) ABSTRACT

A game assembly that enables at least one person to play a board game against a computerized opponent. A game board is provided having a plurality of playing spaces. The game board is configured for a predetermined game having known rules of play. An animated figure is positioned proximate the game board. The animated figure has an arm that can be selectively moved. An automation mechanism is used to selectively move the arm of the figure over the game board during play without touching the game board. The animated figure therefore provides a false appearance that the figure is actually playing the game.

13 Claims, 4 Drawing Sheets

ELECTRONIC BOARD GAME SYSTEM WITH AUTOMATED OPPONENT

BACKGROUND OF THE INVENTION

1. Field of the Invention

In general, the present invention relates to board game systems where a human player can play against a computerized opponent. The present invention also relates to automated figures that have preprogrammed movements controlled by a computer processor.

2. Prior Art Description

Board games have been in existence for many hundreds of years. In that period of time, thousands of board games have been invented. Most all board games are designed to be played by multiple players. Some board games require more than two players to play. However, a great many board games, such as chess, checkers, and backgammon, are designed to be played by only two players.

With the advent of microprocessor technology, board game manufacturers quickly developed computerized board games that enable a human player to play against a computerized opponent. In this manner, a person can play games like chess whenever they desire, without having to locate a human opponent. The marketplace is now replete with various board games and board game simulations that enable a human player to play against a computerized opponent. Some computerized board games are purely software based, wherein a simulation of the board game is produced on a computer screen and the entire game is played through a computer. Other computerized game boards exist that utilize real game pieces on real game boards. In such computerized board games, a player moves his/her own pieces as well as the opposing pieces. The movement of the opposing pieces is decided by a computer that is tracking movements on the game board. For example, there exist several electronic chess games that use real chess pieces. The computer controls lights on the chessboard to instruct the human player where to move the chess pieces on behalf of the computerized player.

There are also board game systems that exist where real playing pieces on a real board game are physically moved by a computer. Commercial chess games are available that automatically move chess pieces on a game board by using electromagnets under the chessboard. Although such games are fun to watch and play, they are extremely sophisticated and very expensive. Such game board systems are therefore economically impractical for a majority of the consuming public.

The present invention is a game board system where a human player can play against a computerized opponent. A computer controlled animated character is positioned next to the game board. The animated character pretends to move electronically produced representations of game pieces on the game board. However, in reality, the animated character does not touch the game board. The animated figure gives the appearance that it is physically playing the game. However, no sophisticated control system is needed to control the animated character and the game board system can be manufactured very inexpensively. The present invention game board system is described and claimed below.

SUMMARY OF THE INVENTION

The present invention is a game assembly that allows a person to play a board game against a computerized opponent. The game assembly includes a game board having a plurality of playing spaces. The game board is configured for a predetermined game having known rules of play. An animated figure is positioned proximate the game board. The animated figure has an arm that can be selectively moved. An automation mechanism is used to selectively move the arm of the figure over the game board during play without touching the game board. The animated figure therefore provides a false appearance that the figure is actually playing the game.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention game board system can be configured for many types of board games, the exemplary embodiment shows a tic-tac-toe game. The tic-tac-toe game is selected for its simplicity. The tic-tac-toe game, however, should be considered indicative of any board game that is typically played by at least two players. Furthermore, the present invention game board system shows a teddy bear figure. This figure is also selected for its simplicity and should be considered indicative of any figure that has a head, torso and arm.

Figure 1:
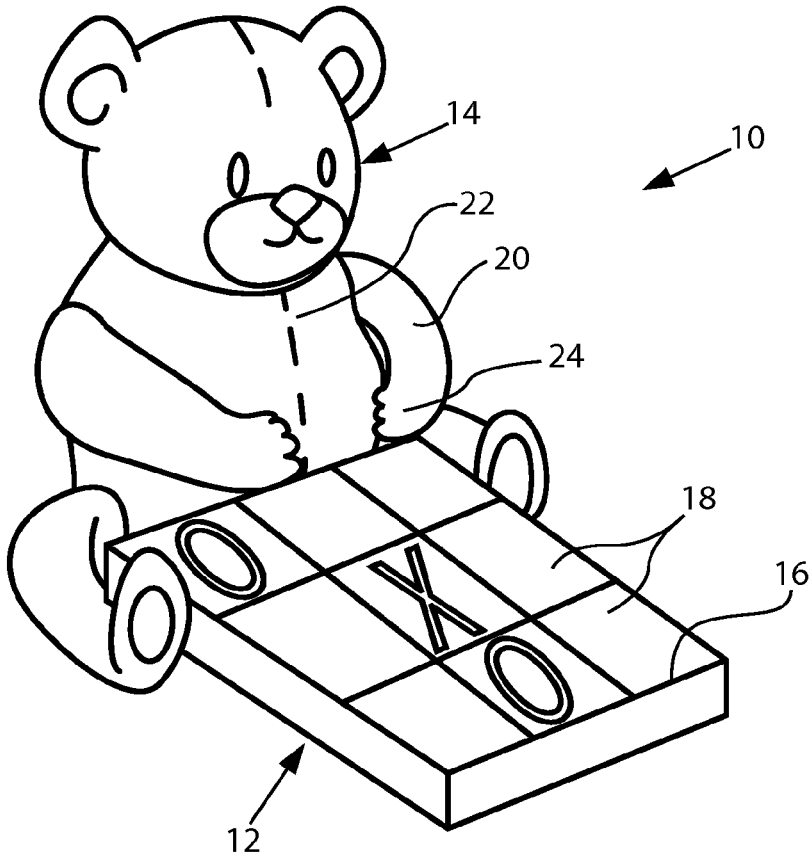
FIG. 1 is a perspective view of an exemplary embodiment of the present invention board game system.

Referring to FIG. 1, the present invention board game system 10 is shown. The board game system 10 includes a game board assembly 12 and an animated FIG. 14 that is positioned adjacent to the game board assembly 12. The game board assembly 12 has a playing surface 16 that is observed by a player. The playing surface 16 can be configured as a checkerboard, a backgammon board, a Monopoly® game board or any other known board game layout. However, in the shown embodiment, the playing surface 16 is configured as a tic-tac-toe board and is therefore segmented into nine playing spaces 18.

An animated FIG. 14 is positioned adjacent to the game board assembly 12 and is oriented to face the playing surface 16. The animated FIG. 14 is controlled by a central processing unit that is contained within the game board assembly 12, as will later be explained.

The animated FIG. 14 has an arm 20 and torso 22 that can be selectively articulated. A hand 24 is positioned at the end of the arm 20. By selectively making certain arm 20 and torso 22 movements, the hand 24 of the animated FIG. 14 can be made to pass over each of the playing spaces 18 present on the playing surface 16. The animated FIG. 14, therefore, has the ability to reach all of the playing spaces 18 on the playing surface 16.

Real playing pieces are not used in the shown embodiment. Rather, images of playing pieces can be electronically generated in each of the playing spaces 18 on the playing surface 16. The playing pieces used to play the game are virtual representations of real playing pieces. The movement of playing pieces is therefore done electronically rather than physically. In the exemplary embodiment of a tic-tac-toe game, a player would want to place an "X" or an "O" into a playing space 18. The game board assembly 12 therefore has the ability to electronically create the image of an "X" and an "O"

in each of the playing spaces 18. The playing spaces 18 on the playing surface 16 also contain touch sensors. In this manner, a player can indicate where they would like to move a virtual playing piece simply by touching the appropriate playing space 18 on the playing surface 16.

Figure 2:
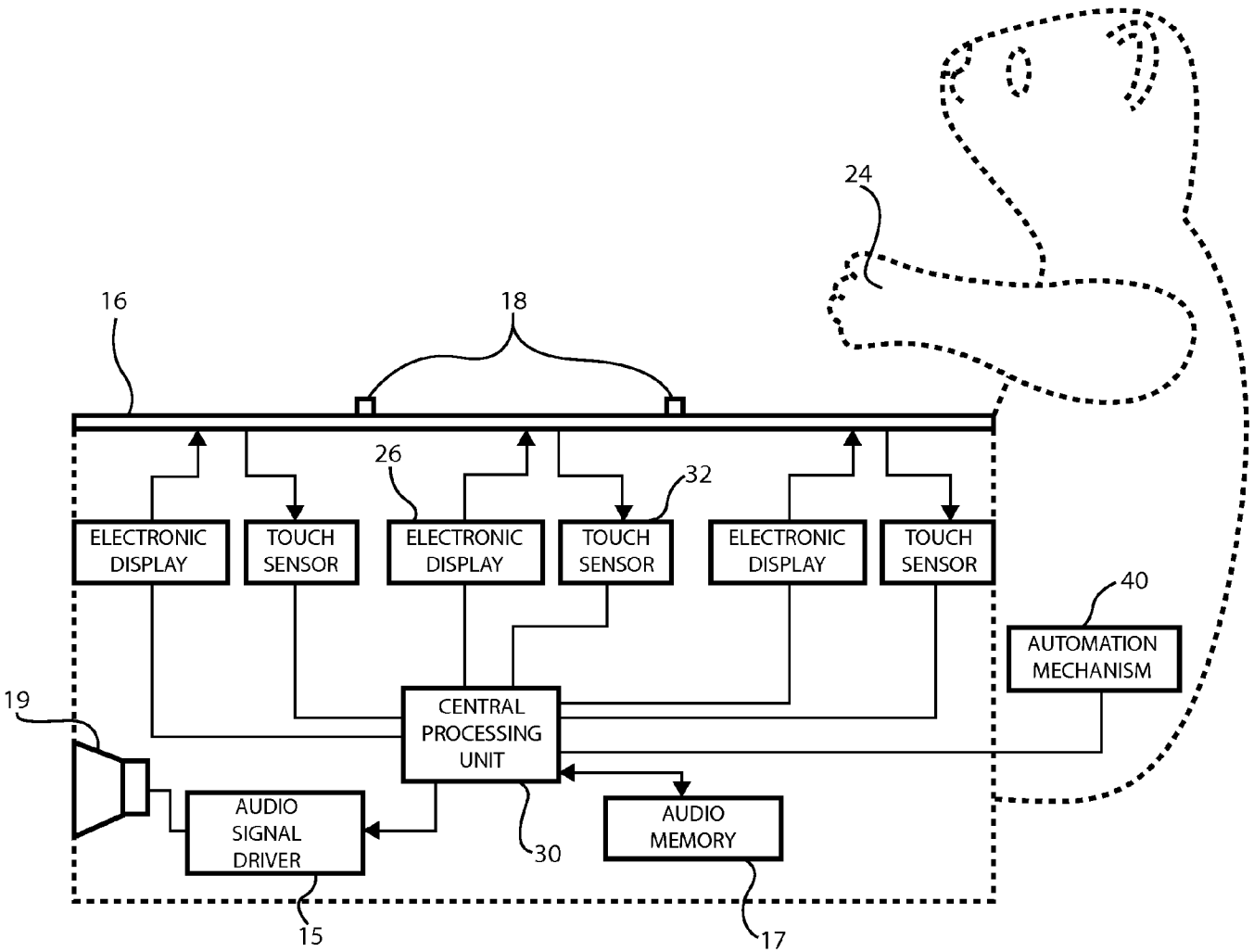
FIG. 2 is a schematic of the present invention board game system.

Referring to FIG. 2, it can be seen that an electronic space display 26 is associated with each of the playing spaces 18 on the playing surface 16. The electronic space display 26 can be an array of light emitting diodes (LEDs), a liquid crystal display, a flat panel screen or any other display that can electronically produce an image that can be identified as a game piece of the game being played. In the exemplary embodiment of a tic-tac-toe game, the electronic space displays 26 need only produce an "X" or an "O". However, if chess were being played, one of the six types of chess pieces, in two colors, would have to be displayed.

The various electronic space displays 26 are coupled to a central processing unit 30. The central processing unit 30 is preprogrammed with the rules of the game being played. In order for the central processing unit 30 to run the game program for the game being played, the central processing unit 30 must know and track the movements of the human player.

A plurality of touch sensors 32 are disposed within the game board assembly 12. At least one touch sensor 32 is associated with each of the playing spaces 18. The touch sensors 32 are coupled to the central processing unit 30. Thus, whenever a human player touches a playing space 18, the central processing unit 30 can determine the intended movement of the human player. For example, in the illustrated example of a tic-tac-toe game, the central processing unit 30 is first informed as to whether the human player is playing "X"s or "O"s. Thus, when a human player touches a playing space 18 on the playing surface 16, the central processing unit 30 will display either an "X" or an "O" as would be appropriate under the rules.

If chess were being played, the human player may have to touch two playing spaces on the playing surface. The first touch would identify the playing piece to be moved. The second touch would identify the playing space where the identified playing piece is to be moved. If the selected move is allowed under the rules of the game, the electronic space displays are updated to represent the selected move.

Once the central processing unit 30 has determined the move of the human player, the central processing unit 30 calculates a countermove in accordance with the game program being run. The central processing unit 30 determines a countermove and executes that countermove by updating the electronic space displays 26 to represent the countermove.

Along with the updating of the electronic space displays 26, the central processing unit 30 sends control signals to the automation mechanisms 40 of the animated FIG. 14. The control signals cause the animated FIG. 14 to move. The movements of the animated FIG. 14 are designed so that it seems as though the animated FIG. 14 is reaching onto the playing surface 16 to play the game in the same manner that a human player would play. However, a human player actually touches the playing spaces 18 on the playing surface 16 and activates a touch sensor 32. The movements of the animated FIG. 14 are choreographed so that the hand 24 of the animated FIG. 14 reaches over the playing surface 16 and mimics the touching of the playing spaces 18.

The central processing unit 30 is programmed with the rules of the game and tracks the status of the game. The central processing unit 20 many also optionally be connected to an audio signal driver 15 and a memory 17 containing prerecorded words or phrases. After each move at play, either by the human player of the central processing unit 30, the central processing unit 30 can recall an appropriate prerecorded word or phrase from the memory 17. The prerecorded word/phrase is sent to the audio signal driver 15 and is broadcast through a speaker 19. Consequently, during play, the central processing unit 20 can be audibly interactive, broadcasting phrases like "your turn", "my Turn", you Win", lets play again", "nice move", and the like.

Figure 3:
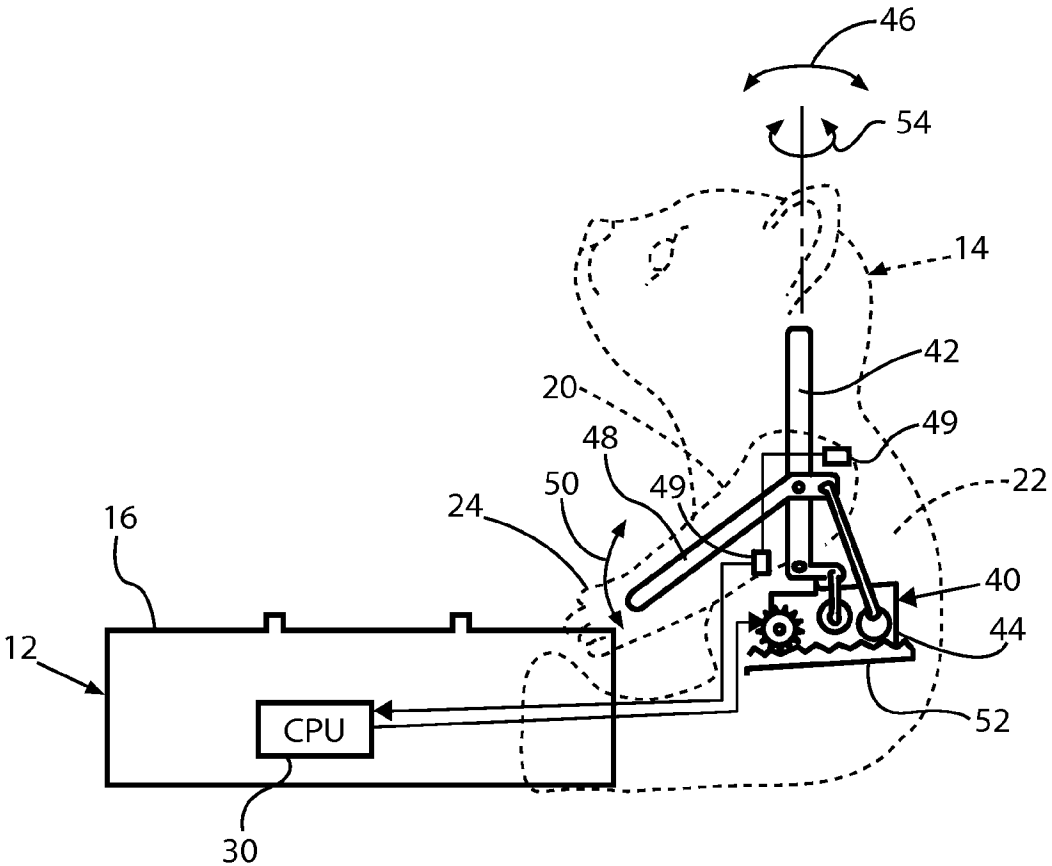
FIG. 3 shows the animated figure in a retracted position.

Referring to FIG. 3, it can be seen that the animated FIG. 14 is positioned adjacent to the playing surface 16 of the game board assembly 12. The animated FIG. 14 has a torso 22 and an articulating arm 20. Within the animated FIG. 14 are various automation mechanisms 40. The automation mechanisms 40 are designed to enable the hand 24 at the end of the articulating arm 20 to reach over all of the playing spaces 18 that are present on the playing surface 16 of the game board assembly 12.

In the shown embodiment, the automation mechanisms 40 include a torso support 42. The torso support 42 extends through the torso 22 and head of the animated FIG. 14. The torso support 42 is connected to a motorized gearbox 44 that can selectively move the torso support 42 back and forth in the directions of arrow 46. The animation mechanisms 40 also include an arm support 48. The arm support 48 extends down the articulating arm 20. The arm support 48 connects to the motorized gearbox 44, wherein the motorized gearbox 44 can selectively raise and lower the articulating arm 20 in the directions of arrow 50.

In the shown embodiment, a single motorized gearbox 44 is shown. It will be understood that a plurality of motorized gearboxes can be used, if desired. The use of one motorized gearbox 44 is shown for the sake of simplicity.

The motorized gearbox 44 itself is set upon a rotation platform 52. The motorized gearbox 44 can selectively rotate on the platform 52, thereby rotating the torso 22 of the animated FIG. 14 around a vertical axis, as indicated by arrow 54.

The motorized gearbox 44 is connected to the central processing unit 30. The central processing unit 30 therefore selectively controls the movements of the torso 22 and the articulating arm 20. In FIG. 3, the animated FIG. 14 is shown with its torso 22 essentially erect in a vertical orientation. In this position, the articulating arm 20 of the animated FIG. 14 is fully lowered into a waiting position. In this waiting position, the hand 24 at the end of the articulating arm 20 is not positioned over the playing surface 16. The animated FIG. 14 therefore assumes this waiting position when it is the human player's turn at play. The animated FIG. 14 presents the appearance that the animated FIG. 14 is waiting to play.

Sensors 49 are provided that sense the position of the torso support 42 and the arm support 46. In the sensors are coupled to the central processing unit 30. In this manner, the central processing unit 30 can detect the position of the torso support 42 and arm support 46, starting and stopping the movement of these elements as required.

Figure 4:
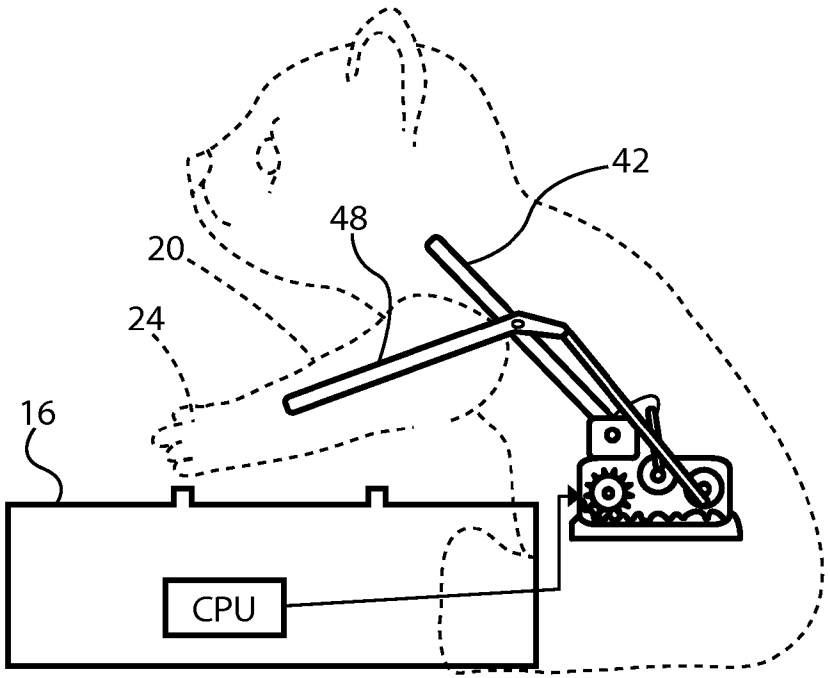
FIG. 4 shows the animated figure in an extended position.

Referring to FIG. 4, the animated FIG. 14 is shown in a fully extended position. In this fully extended position, the arm support 48 is fully raised and the torso support 42 is fully bent forward. In the fully raised position, the hand 24 at the end of the articulating arm 20 can be positioned over the playing spaces 18 (FIG. 1) at the far end of the playing surface 16. Different playing spaces 18 at the far end of the playing surface 16 can be reached by additionally rotating the torso 22 to the left or right.

It will be understood that by selectively extending the arm support 48, the torso support 42 and rotating the torso 22 in amounts less than what is shown for the fully extended position, the hand 24 of the animated FIG. 14 can be caused to pass over any of the playing spaces 18 on the playing surface 16.

Returning to FIG. 1, the method of operation associated with the present invention board game system 10 will be understood. A human player, desiring to play the board game system 10, starts the system. The animated FIG. 14 will move to its rest position that was shown in FIG. 3. The human player then touches a playing space 18 on the playing surface 16 to indicate a desired move. The electronic space displays 26 (FIG. 2) will update to reflect the human player's move. Once the human player completes the move, the internal central processing unit 30 (FIG. 2) calculates a countermove and changes the electronic space displays 26 (FIG. 2) to execute that countermove. Simultaneously, the internal central processing unit activates the animated FIG. 14 and causes the animated FIG. 14 to move. The animated FIG. 14 reaches out over the playing spaces 18 and appears to touch the playing spaces 18 in the same manner as did the human player. The animated figure does not randomly move. Rather, the animated figure moves its articulating arm 20 to the position on the playing surface 16 that corresponds to the countermove calculated by the internal central processing unit. The physical movements of the animated FIG. 14 are therefore coordinated with the countermove calculated by the internal central processing unit 30 (FIG. 2).

It will be understood that the embodiment of the present invention board game system that is shown is merely exemplary and that a person skilled in the art can make many variations to that embodiment. For example, the teddy bear shape of the animated figure can be changed and is a matter of design choice. Similarly, many games other than tic-tac-toe can be played. It will also be understood that numerous mechanisms can be used to selectively move the arm and torso of the animated figure. All such variations, modifications and alternate embodiments are considered to be included within the scope of the present invention as set forth by the claims.

What is claimed is:

1. A game assembly, comprising:

a game board having a plurality of playing spaces thereon, said game board being configured for a predetermined game having known rules of play;

a microprocessor that is programmed with said rules of play so as to calculate and execute an automated move in said predetermined game, wherein said automated move involves at least one of said playing spaces;

a figure positioned proximate said game board, wherein said figure has an arm; and an automation mechanism for selectively moving said arm of said figure over said game board from an initial rest position to a position over said at least one of said playing spaces involved within said automated move without physically moving anything on said game board.

2. The assembly according to claim 1, further including a plurality of displays, wherein a display is disposed in each of said playing spaces for presenting a visual representation of a game piece used in said predetermined game.

3. The assembly according to claim 2, wherein said microprocessor changes at least one of said displays as said microprocessor executes said automated move during play of said predetermined game.

4. The assembly according to claim 1, further including touch sensors disposed in said playing spaces of said game board that are coupled to said microprocessor.

5. The assembly according to claim 1, wherein said figure has a torso and said arm extends from said torso.

6. The assembly according to claim 5, wherein said automation mechanism can selectively rotate said torso of said figure throughout a first range of movement.

7. The assembly according to claim 6, wherein said automation mechanism can selectively raise and lower said torso of said figure throughout a second range of movement.

8. The assembly according to claim 7, wherein said automation mechanism can selectively raise and lower said arm relative said torso throughout a third range of movement.

9. A system, comprising:

a board game assembly having a play surface with play spaces;

a microprocessor that enables play of a game on said play surface between a human player and a game program being run by said microprocessor, wherein said game program, during an automated turn at play, calculates moves involving at least one of said play spaces; and an animated figure disposed proximate said play surface, wherein a portion of said animated figure moves from a rest position to a position above said playing spaces involved within said automated turn at play without physically moving anything upon said play surface.

10. The system according to claim 9, further including a plurality of displays, wherein a display is disposed in each of said playing spaces for presenting a visual representation of a game piece used in said game.

11. The system according to claim 10, wherein said microprocessor changes at least one of said displays as said microprocessor executes said automated turn at play.

12. The system according to claim 9, wherein said animated figure has a torso and an arm that can both be moved independently.

13. A method of operating a game system, comprising the steps of:

providing a game board configured for a predetermined game, said game board having playing spaces;

providing a microprocessor for running a game program that enables a human player to play said predetermined game against said game program, wherein said microprocessor generates changing images of playing pieces in said playing spaces as said microprocessor runs said game program; and providing an animated figure with an arm proximate said game board, wherein said arm moves above each of said playing spaces having a changed image generated there upon by said microprocessor without touching said playing spaces.

* * * * *